US012006093B2

(12) United States Patent
Major et al.

(10) Patent No.: US 12,006,093 B2
(45) Date of Patent: Jun. 11, 2024

(54) PALLET ASSEMBLY

(71) Applicant: Formall, Inc., Clinton, TN (US)

(72) Inventors: Daniel Major, Clinton, TN (US); Gerd Krohn, Clinton, TN (US)

(73) Assignee: Formall, Inc., Clinton, TN (US)

( * ) Notice: Subject to any disclaimer, the term of this patent is extended or adjusted under 35 U.S.C. 154(b) by 0 days.

(21) Appl. No.: 18/324,647

(22) Filed: May 26, 2023

(65) Prior Publication Data

US 2023/0294874 A1 Sep. 21, 2023

Related U.S. Application Data

(63) Continuation of application No. 17/443,446, filed on Jul. 26, 2021, now Pat. No. 11,661,237.

(60) Provisional application No. 63/056,221, filed on Jul. 24, 2020.

(51) Int. Cl.
*B65D 19/44* (2006.01)
*B65D 19/00* (2006.01)

(52) U.S. Cl.
CPC ..... *B65D 19/44* (2013.01); *B65D 19/0002* (2013.01); *B65D 2519/00034* (2013.01); *B65D 2519/00069* (2013.01); *B65D 2519/00268* (2013.01); *B65D 2519/00288* (2013.01); *B65D 2519/00318* (2013.01); *B65D 2519/00338* (2013.01); *B65D 2519/00815* (2013.01); *B65D 2519/00965* (2013.01)

(58) Field of Classification Search
CPC ..... B65D 19/44; B65D 2519/00815; B65D 2519/00034; B65D 2519/00069; B65D 2519/00268; B65D 2519/00965; B65D 2519/00338
USPC ..... 108/53.5, 55.1, 55.3, 53.3
See application file for complete search history.

(56) References Cited

U.S. PATENT DOCUMENTS

| | | | |
|---|---|---|---|
| 2,444,326 | A | 6/1948 | Baker |
| 3,167,341 | A | 1/1965 | Higgins |
| 3,266,605 | A | 8/1966 | Anderson |
| 3,424,110 | A | 1/1969 | Toot |
| 3,524,415 | A | 8/1970 | Heiman |
| 3,526,195 | A | 9/1970 | Maryonovich |
| 3,611,952 | A | 10/1971 | Hoffman |
| 3,628,468 | A | 12/1971 | Angelbeck |
| 3,707,127 | A | 12/1972 | Palfey |
| 3,993,168 | A | 11/1976 | Kubick |
| 4,000,704 | A | 1/1977 | Griffin, Jr. |
| 4,319,530 | A | 3/1982 | Moog |

(Continued)

FOREIGN PATENT DOCUMENTS

| | | |
|---|---|---|
| CN | 2359940 | 1/2000 |
| CN | 2363546 | 2/2000 |

(Continued)

*Primary Examiner* — Jose V Chen
(74) *Attorney, Agent, or Firm* — Robinson IP Law, PLLC

(57) ABSTRACT

A pallet having: a pallet body having a first side and an opposing second side; at least one formed portion located on the first side of the pallet body and shaped to receive a rigid elongate first item thereon, the formed portion oriented substantially along a lengthwise axis of the pallet body. When the elongate first item is substantially retained on the formed portion of the pallet body such that when the elongate first item is secured thereon, a lengthwise rigidity of the pallet body is enhanced by the rigid elongate first item.

10 Claims, 10 Drawing Sheets

(56) References Cited

U.S. PATENT DOCUMENTS

| | | | | |
|---|---|---|---|---|
| 4,480,748 | A | 11/1984 | Wind | |
| 4,580,680 | A | 4/1986 | Wind | |
| D288,978 | S | 3/1987 | Wind | |
| 5,097,951 | A | 3/1992 | Pigott | |
| 5,147,039 | A | 9/1992 | Sechler | |
| 5,249,699 | A | 10/1993 | Williams | |
| D347,509 | S | 5/1994 | Junaedi | |
| 5,359,955 | A | 11/1994 | Grebenyuk | |
| 5,520,121 | A | 5/1996 | Schubart | |
| D370,765 | S | 6/1996 | Heintz | |
| 5,638,760 | A | 6/1997 | Jordan | |
| 6,123,651 | A | 9/2000 | Ellenburg | |
| D441,957 | S | 5/2001 | Kelly | |
| 7,458,920 | B2 | 12/2008 | Hallar | |
| 7,661,373 | B2 | 2/2010 | Apps et al. | |
| 8,141,500 | B2 | 3/2012 | Naidu et al. | |
| D682,503 | S | 5/2013 | Fehrman, Jr. et al. | |
| D691,343 | S | 10/2013 | Levoir et al. | |
| 8,550,243 | B2 | 10/2013 | Moore | |
| D766,539 | S | 9/2016 | Lee | |
| 9,745,099 | B2 | 8/2017 | Takyar et al. | |
| 9,988,183 | B2 | 6/2018 | Ikeguchi | |
| D911,662 | S | 2/2021 | Wheaton | |
| D925,158 | S | 7/2021 | Ramon et al. | |
| D925,159 | S | 7/2021 | Furunes et al. | |
| D925,859 | S | 7/2021 | Ramon et al. | |
| D930,940 | S | 9/2021 | Cohen | |
| D946,234 | S | 3/2022 | Major | |
| 11,661,237 | B1 * | 5/2023 | Major | B65D 19/44 108/53.5 |
| 2005/0121345 | A1 | 6/2005 | Cho | |
| 2007/0287608 | A1 | 12/2007 | Hallar | |
| 2008/0023355 | A1 | 1/2008 | Reynolds | |
| 2008/0295748 | A1 | 12/2008 | Yoshida | |
| 2012/0291678 | A1 | 11/2012 | Howland | |
| 2013/0136573 | A1 | 5/2013 | Berry | |
| 2013/0206043 | A1 | 8/2013 | Baltz | |
| 2014/0345500 | A1 | 11/2014 | Dunn | |
| 2015/0291305 | A1 | 10/2015 | Mueller | |
| 2015/0298854 | A1 | 10/2015 | Linares | |
| 2016/0067542 | A1 | 3/2016 | Piga | |
| 2016/0075470 | A1 | 3/2016 | Liao | |
| 2016/0251114 | A1 | 9/2016 | Lee | |
| 2017/0252595 | A1 | 9/2017 | Beaver et al. | |
| 2018/0099779 | A1 | 4/2018 | Apps et al. | |
| 2018/0162590 | A1 | 6/2018 | Deutsch | |
| 2018/0290789 | A1 | 10/2018 | Jain | |
| 2018/0322453 | A1 | 11/2018 | Lantz | |
| 2019/0177038 | A1 | 6/2019 | Veldhuis | |
| 2019/0240528 | A1 | 8/2019 | Donnelly et al. | |
| 2022/0041330 | A1 | 2/2022 | Sostmann | |

FOREIGN PATENT DOCUMENTS

| | | |
|---|---|---|
| CN | 2371156 | 3/2000 |
| CN | 2485254 | 4/2002 |
| CN | 2485255 | 4/2002 |
| CN | 2548946 | 5/2003 |
| CN | 2825506 | 10/2006 |
| CN | 205989909 | 3/2017 |
| CN | 206152167 | 5/2017 |
| CN | 108001883 | 5/2018 |
| DE | 2440242 | 3/1976 |
| DE | 20221183 | 6/2005 |
| DE | 202013000624 | 2/2013 |
| DE | 112012006489 | 2/2015 |
| GB | 2274833 | 8/1994 |
| GB | 2412107 | 9/2005 |
| GB | 2437259 | 10/2007 |
| WO | WO9906290 | 2/1999 |
| WO | WO0216214 | 2/2002 |

* cited by examiner

PALLET ASSEMBLY

CROSS-REFERENCE TO RELATED APPLICATION(S)

This application claims priority to and is a continuation of U.S. Non-Provisional patent application Ser. No. 17/443,446 for a "Pallet Assembly" filed on Jul. 26, 2021, which claims priority to and is a non-provisional of U.S. Provisional Patent Application Ser. No. 63/056,221 for a "Pallet Assembly" filed on Jul. 24, 2020, the contents of which are incorporated herein by reference in its entirety.

FIELD

This disclosure relates to the field of pallets and transportation of items thereon. More particularly, embodiments of this disclosure relate to a pallet assembly structurally reinforced by items transported on the pallet.

BACKGROUND

Various pallets exist that may be used to transport goods. For example, wooden pallets have long existed that allow items to be placed on top of and secured to the pallet for transportation of those items. Although low-cost, wooden pallets have several disadvantages. For example, wooden pallets may not be durable and may break after or during use. Further, wooden pallets may be susceptible to deteriorating, such as due to the pallets becoming wet or otherwise becoming exposed to moisture or weather conditions, thereby limiting a life span of the pallets. Wooden pallets may also become infested, such as with bugs or insects, thereby requiring additional treatment or otherwise complicating efforts to ship the wooden pallets abroad.

Attempts have been made to create pallets formed of other materials, such as plastics. Pallets formed of plastics and composite materials may be more durable than wooden pallets and resistant to decay and infestation. Pallets formed of plastic are therefore preferable as being re-usable or returnable. However, to make a plastic pallet stronger, the pallet must either be reinforced with additional material or support members. To make a plastic or composite pallet stronger using support members or additional reinforcing material, significant weight and cost is added to the pallet in addition to the weight of any items that are to be transported on the pallet. Increased weight of the pallet may make the pallets more difficult to move manually, and further may add to any shipping costs associated with transporting items on the pallet. Additional disadvantages of current pallets, such as pallets having reinforcing members built into the pallets, is that recycling of the pallets may involve separation of different materials in the pallet. For example, if a plastic pallet includes metal reinforcing members, recycling requires both materials to be separated which may be difficult and costly.

What is needed, therefore, is a pallet assembly that is structurally reinforced without adding significant weight or cost to the pallet.

SUMMARY

The above and other needs are met by a pallet assembly that is structurally reinforced without adding significant weight or cost to the pallet. In a first aspect, a pallet includes: a pallet body having a first side and an opposing second side; at least one formed portion located on the first side of the pallet body and shaped to receive a rigid elongate first item thereon, the formed portion oriented substantially along a lengthwise axis of the pallet body. When the elongate first item is substantially retained on the formed portion of the pallet body such that when the elongate first item is secured thereon, a lengthwise rigidity of the pallet body is enhanced by the rigid elongate first item.

In one embodiment, the pallet further includes a cap shaped to fit over the first side of the pallet body and over the rigid elongate first item located thereon.

In another embodiment, the formed portion comprises a channel located substantially along a length of the pallet body. In yet another embodiment, the channel is shaped to receive a barbell such that the barbell enhances a lengthwise rigidity of the pallet. In one embodiment, the channel further comprises an undercut to substantially retain the rigid elongate first item on the channel.

In another embodiment, the pallet body is formed of a plastic such that the pallet body is flexible along a length of the pallet body when the rigid elongate first item is not located on the formed portion of the pallet body.

In yet another embodiment, the pallet body further includes one or more cutouts for supporting one or more second items thereon. In one embodiment, the one or more cutouts are located such that the one or more second items are located on top of the rigid elongate first item. In another embodiment, the cutouts are shaped to receive a plurality of weight plates on top of the rigid elongate first item. In yet another embodiment, the cutouts are located such that the plurality of weight plates located thereon at least partially overlap with the at least one formed portion and the rigid elongate first item located thereon.

In a second aspect, a pallet includes: a pallet body having a first side and an opposing second side; at least one formed portion located on the first side of the pallet body and shaped to receive a rigid elongate barbell, the formed portion comprising a channel located substantially along a length of the pallet body and oriented substantially along a lengthwise axis of the pallet body. When the elongate barbell is substantially retained on the formed portion of the pallet body such that when the elongate barbell is secured thereon, a lengthwise rigidity of the pallet body is enhanced by the elongate barbell.

In one embodiment, the pallet body further includes one or more cutouts for supporting one or more weight plates thereon. In another embodiment, the cutouts are located such that the plurality of weight plates located thereon at least partially overlap with the at least one formed portion and the elongate barbell located thereon.

In a third aspect, a pallet includes: a pallet body having a first side and an opposing second side; at least one formed portion comprising a channel located substantially along a length of the pallet body located on the first side of the pallet body and shaped to receive a rigid elongate first item thereon, the formed portion oriented substantially along a lengthwise axis of the pallet body; a cap shaped to fit over the first side of the pallet body and over the rigid elongate first item located thereon. When the elongate first item is substantially retained on the formed portion of the pallet body such that when the elongate first item is secured thereon, a lengthwise rigidity of the pallet body is enhanced by the rigid elongate first item. The pallet body is formed of a plastic such that the pallet body is flexible along a length of the pallet body when the rigid elongate first item is not located on the formed portion of the pallet body.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
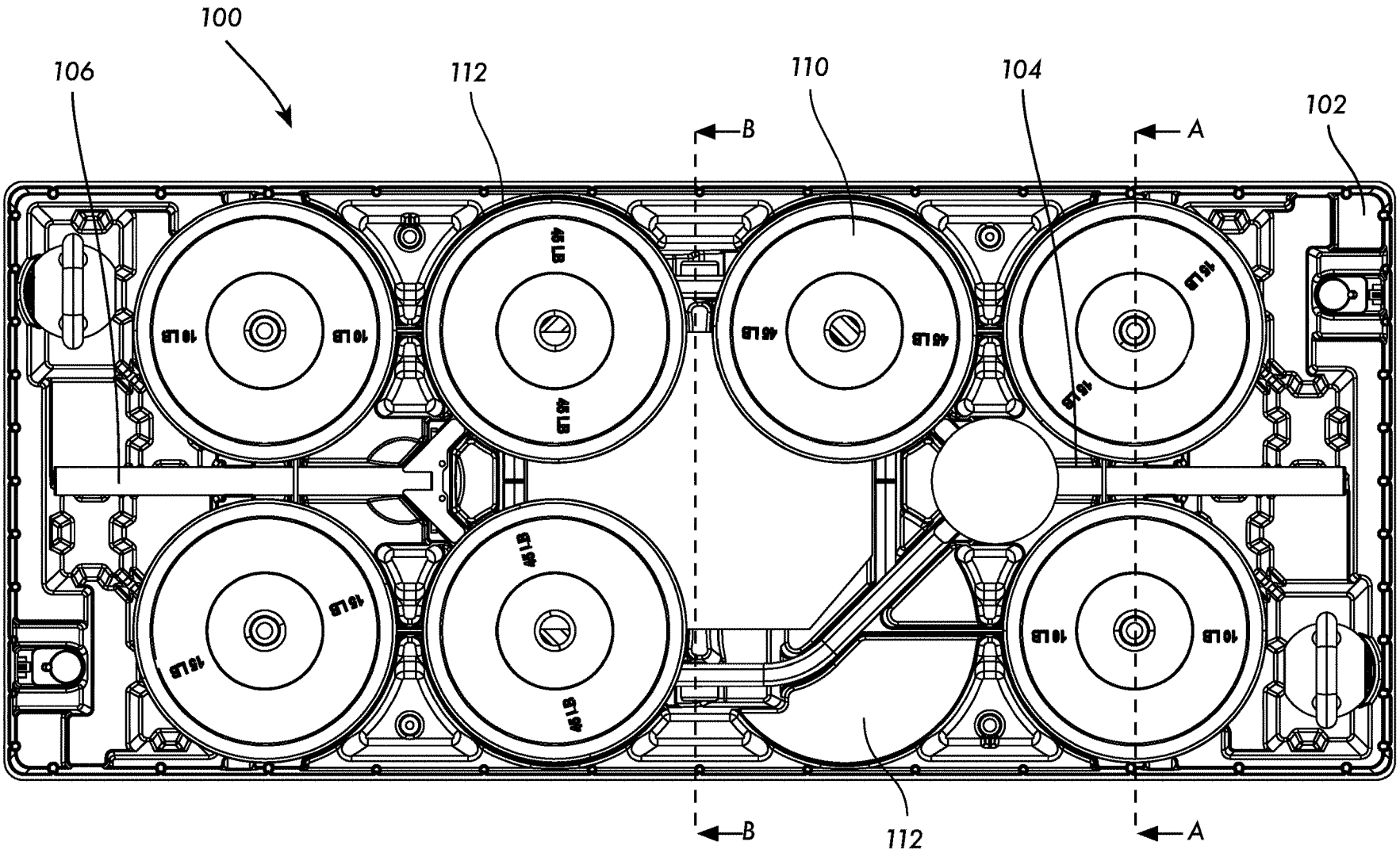
FIG. 1 shows a top plan view of a pallet assembly according to one embodiment of the present disclosure.

FIG. 1 shows an embodiment of a pallet 100. The pallet 100 may be formed of a plastic or composite material such that the pallet 100 is durable. The pallet 100 is adapted to transport one or more items thereon, and may be adapted to transport items that are substantially rigid. The items may be mounted and secured on the pallet 100 such that the items increase a structural rigidity or integrity of the pallet 100. Embodiments of the pallet 100 described herein secure items on the pallet 100 such that the items may become stressed members of the pallet 100. Other items may be located on the pallet 100 and supported by the pallet 100 and the items secured thereon.

As shown in FIG. 1, the pallet 100 includes a pallet body 102. The pallet body 102 may be elongate and planar in shape, as shown in FIG. 1. For example, and as shown in FIG. 1, the pallet body 102 is substantially rectangular in shape, but it is also understood that the pallet body 102 may be formed into other various shapes suitable for transport of items on the pallet 100. The pallet body 102 may be formed of a plastic or composite material. For example, the pallet body 102 is formed or molded of plastics and/or composite materials, such as high molecular weight polyethylene. A thickness of the pallet body 102 may vary along a length and across a width of the pallet body 102.

The pallet body 102 is shaped to receive one or more items thereon and to secure the one or more items to the pallet 100 such that at least one of the one or more items enhance structural rigidity of the pallet 100. Structural rigidity of the pallet may be additionally enhanced when other of the one or more items are placed on the pallet 100. In the exemplary embodiment of FIG. 1 and as described below, the one or more items are shown as including weightlifting and exercise equipment. However, it is also understood that other items may be suitable for use with the pallet assembly described herein wherein one or more of those items lend structural support to the pallet 100 when located on the pallet 100.

Figure 2:
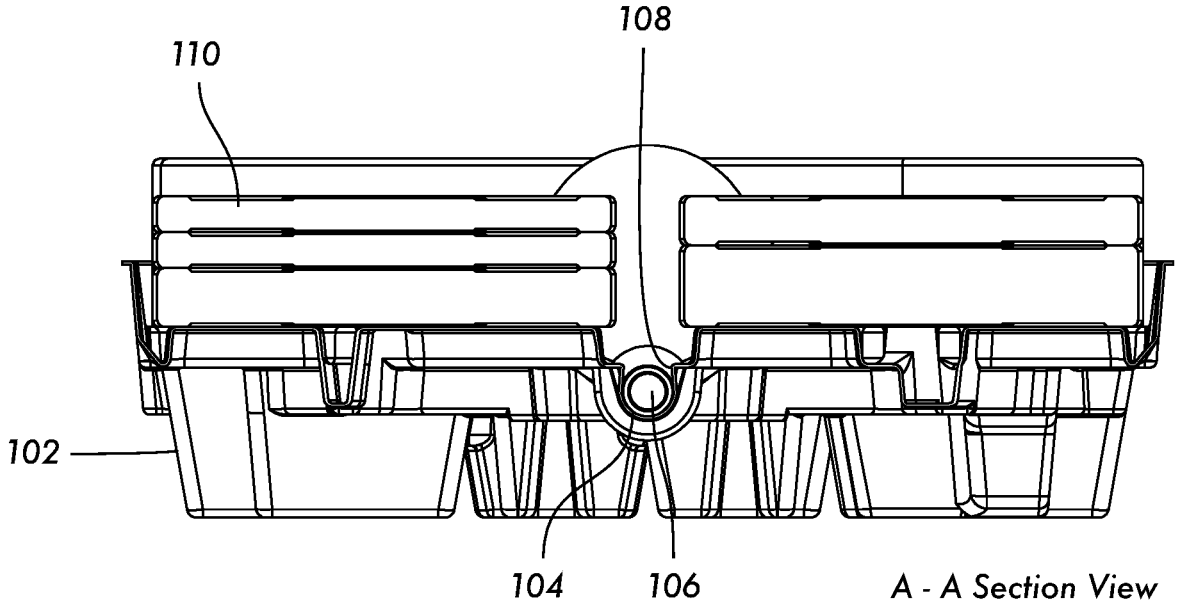
FIGS. 2 and 3 show cross-sectional side views of a pallet assembly along a length of the pallet assembly according to one embodiment of the present disclosure.
Figure 3:
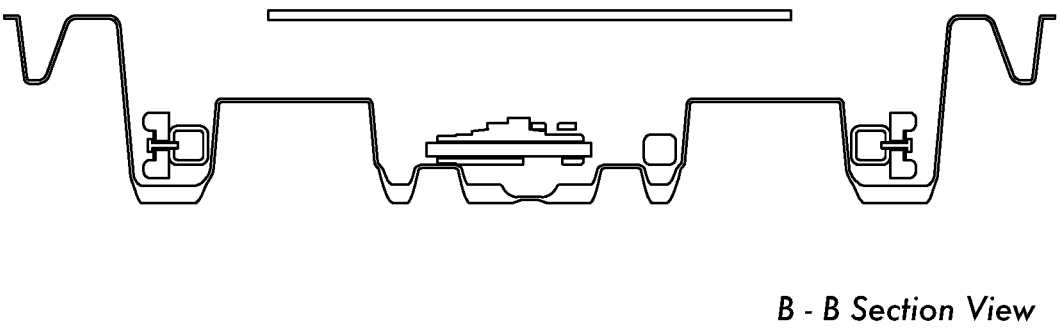

Referring to FIGS. 1 and 2, the pallet 100 includes at least a first formed portion 104 in the pallet body 102 for receiving a first item 106 on the pallet 100. In FIG. 1, the first item 106 is shown as being a trap bar or hex bar that extends substantially along a length of the pallet 100. Although the figures show a trap or hex bar located on the pallet 100, it is understood that a shape of the first formed portion 104 may vary depending on the item to be placed on the pallet 100. For example, the formed portion 104 may be shaped to receive other exercise equipment, such as an elongated weight bar such as a bench press bar or a bench press bench. Although the figures illustrate the first item 106 being exercise equipment, it is also understood that various other items to be transported are suitable as the first item 106 and are not limited to exercise equipment.

The first formed portion 104 may be oriented along an axis that is parallel to a lengthwise axis of the pallet 100 as shown in FIG. 1. The first formed portion 104 may be formed along a lengthwise axis of the pallet 100 such that when the first item 106 is secured on the pallet 100 at the first formed portion 104 as discussed in greater detail below, the first item 106 structurally enhances the pallet 100 along its longest axis. For example, locating the first item 106 on the first formed portion 104 along a lengthwise axis of the pallet 100 may prevent the pallet 100 from bending or flexing along a length of the pallet 100 as described in greater detail below. Alternatively, the first formed portion 104 may otherwise be oriented on the pallet 100 suitable for transporting the first item 106.

Referring to FIG. 2, the first formed portion 104 may be a channel, groove, or recess formed in the pallet body 102 for receiving the first item 106 on the pallet 100. The first item 106 may be secured on the pallet 100, such as within the first formed portion 104 of the pallet body 102. Although reference is made to the first formed portion 104 being a channel, groove, or recess, it is also understood that the first formed portion 104 may include a plurality of channels, grooves, recesses, or other portions of the pallet body 102 that are shaped to receive at least a portion of the first item 106. For example, less than all of the first item 106 may be located within the first formed portion 104. The first formed portion 104 may include a plurality of locations where only a portion of the first item 106 is located within the first formed portion 104 for securing the first item 106 on the pallet 106.

The first item 106 may be removably secured to the pallet body 102. Referring again to FIG. 2, in one embodiment the first formed portion 104 includes an undercut 108 such that at least a portion of the first formed portion 104 extends over the first formed portion 104 for securing the first item 106 therein. The undercut 108 is shaped such that a width of the first formed portion 104 is less than a width of the first item 106 secured therein, thereby securing the first item 106 within the first formed portion 104. The portion of the first formed portion 104 extending over the first formed portion 104 may deflect, such that the first item 106 may be readily placed within and removed from the first formed portion 104 of the pallet body 102.

In other embodiments, the first item 106 may be secured in the first formed portion 104, such as using one or more straps, fasteners, or other similar securing means. For example, a strap or other member may extend over the first formed portion 104 such that the first item 106 is prevented from moving out of the first formed portion 104.

Referring again to FIG. 1, the pallet 100 further may include additional formed portions for securing additional items on the pallet body 102 of the pallet 100. For example, as shown in the figures additional items may include other weightlifting or exercise equipment such as weights 110 that are located on the pallet 100. The weights 110 may be weight plates, such as circular weight plates shaped to fit on the bar that forms the first item 106 as shown in the figures. The pallet body 102 may include one or more cutouts 112 formed thereon for maintaining the weights 110 in place on the pallet 100. The one or more cutouts 112 may be sized to receive the weights 110 on the one or more cutouts 112. The one or more cutouts 112 may be located such that when the weights 110 are located thereon, at least a portion of the weights 110 overlaps with the first item 106 when the first item 106 is located within the first formed portion 104 of the pallet body 102.

The one or more cutouts 112 may include an upwardly extending post located at a center of the one or more cutouts 112. The post may be shaped to fit within an inner bore formed through the weights 110 such that a position of the weights 110 on the pallet 100 is maintained. Referring to FIG. 2, the weights 110 may be stacked when located on the pallet 100.

Figure 4:
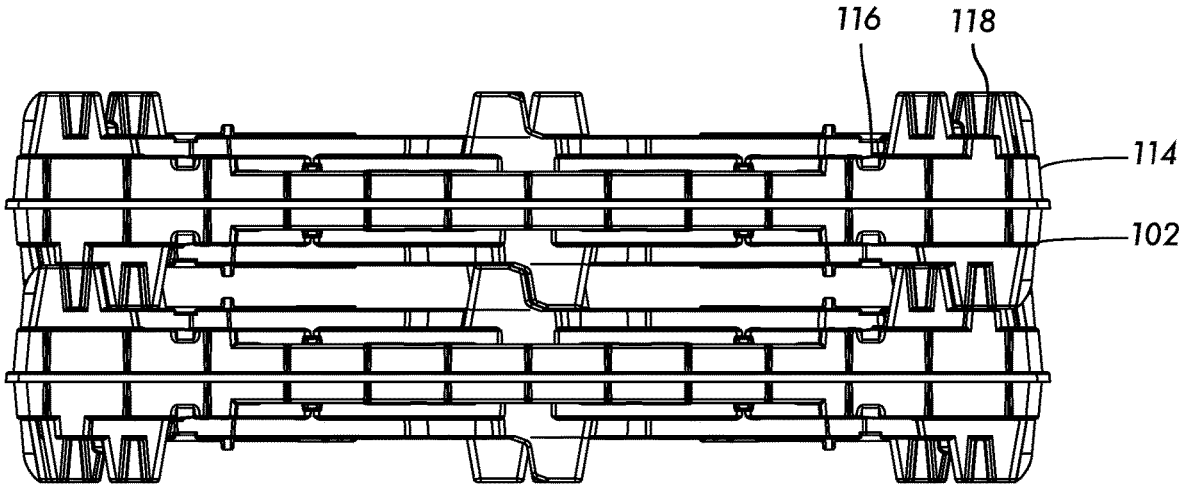
FIG. 4 shows a perspective view of the pallet body of the pallet assembly according to one embodiment of the present disclosure.
Figure 5:
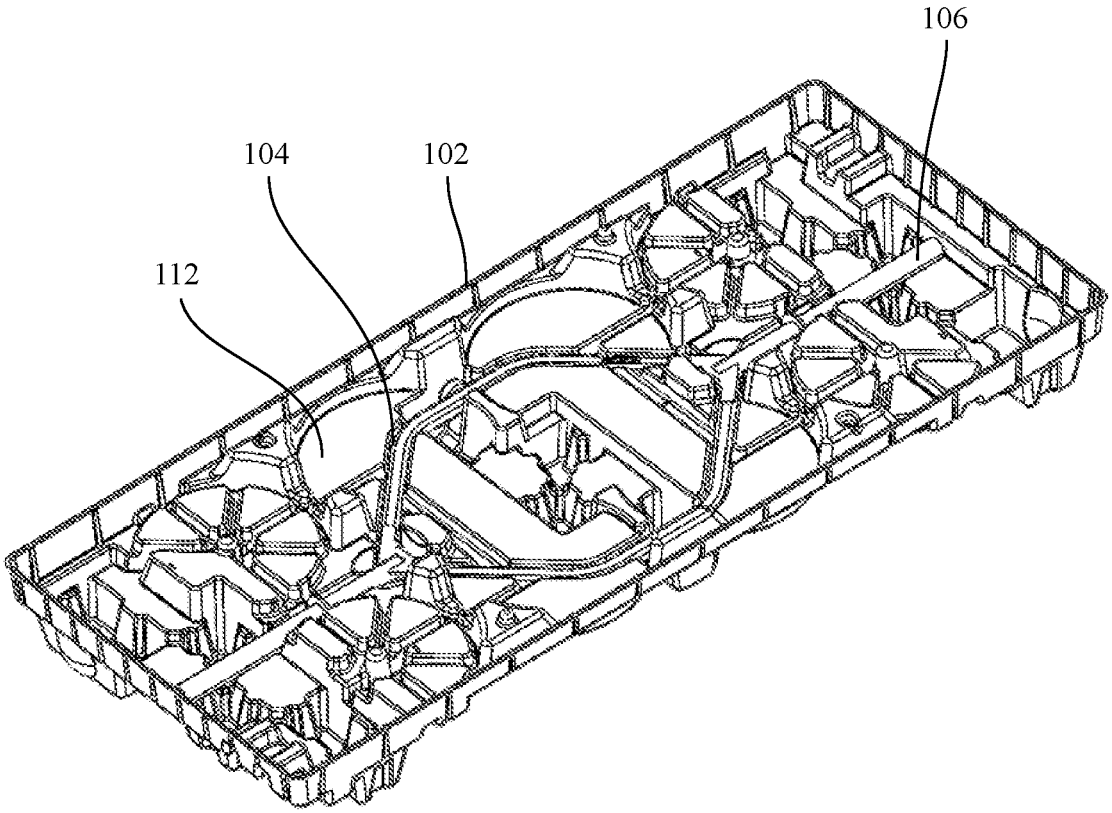
FIG. 5 shows a perspective top view of a pallet according to one embodiment of the present disclosure.
Figure 6:
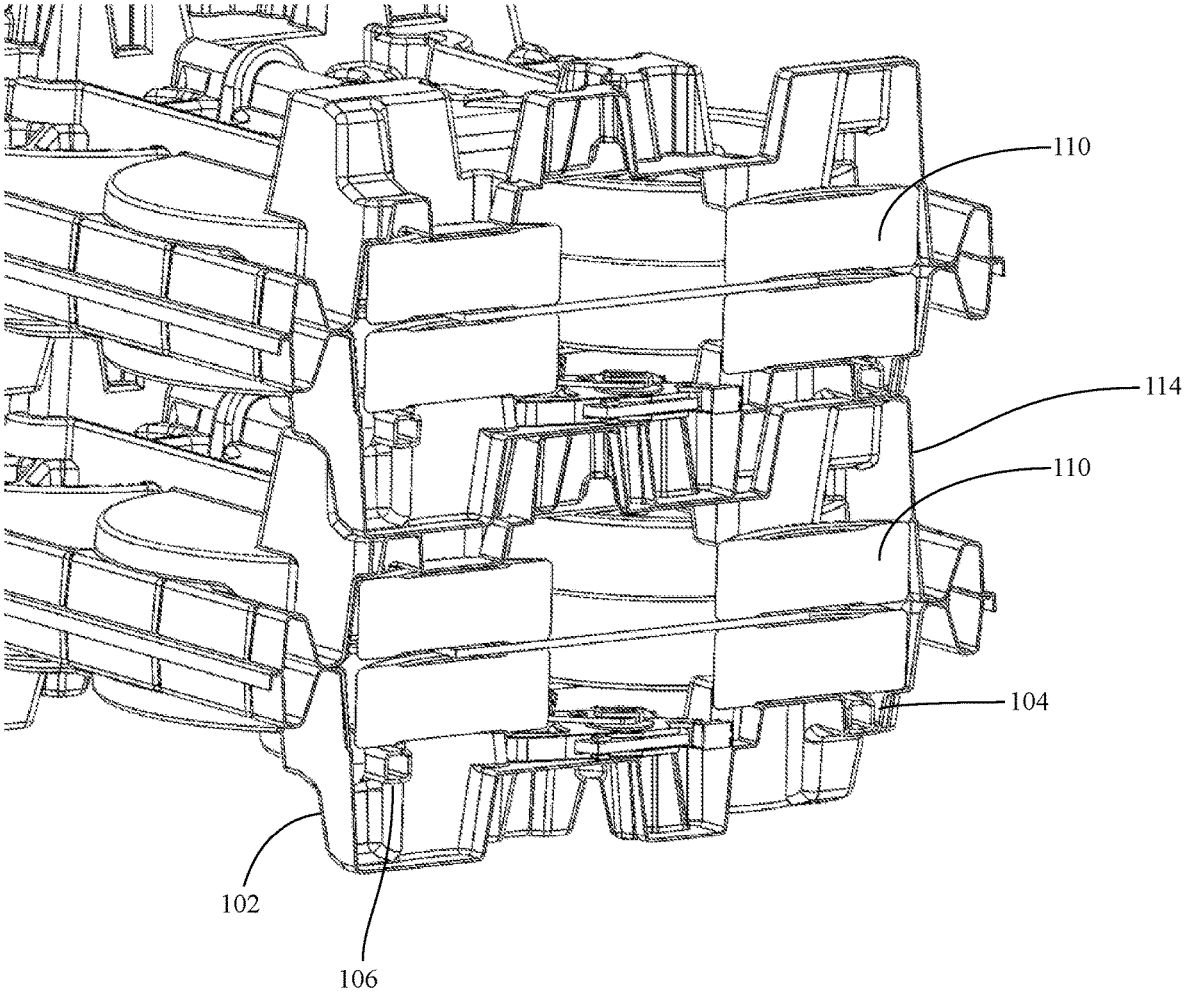
FIG. 6 shows a cross-sectional side view of pallet assemblies according to one embodiment of the present disclosure.
Figure 7:
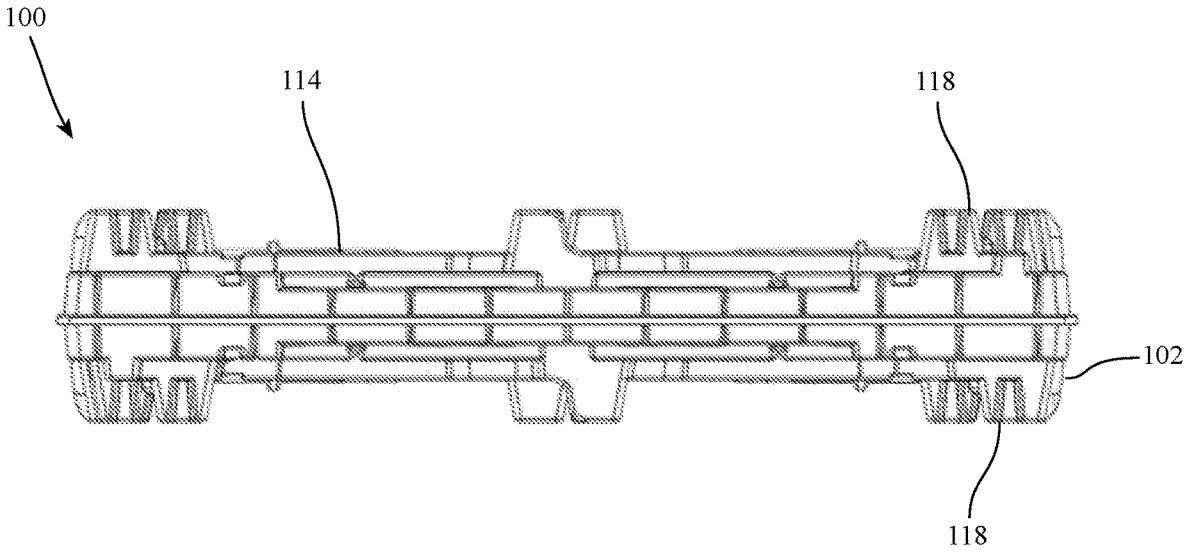
FIG. 7 shows a side view of a pallet assembly according to one embodiment of the present disclosure.
Figure 8:
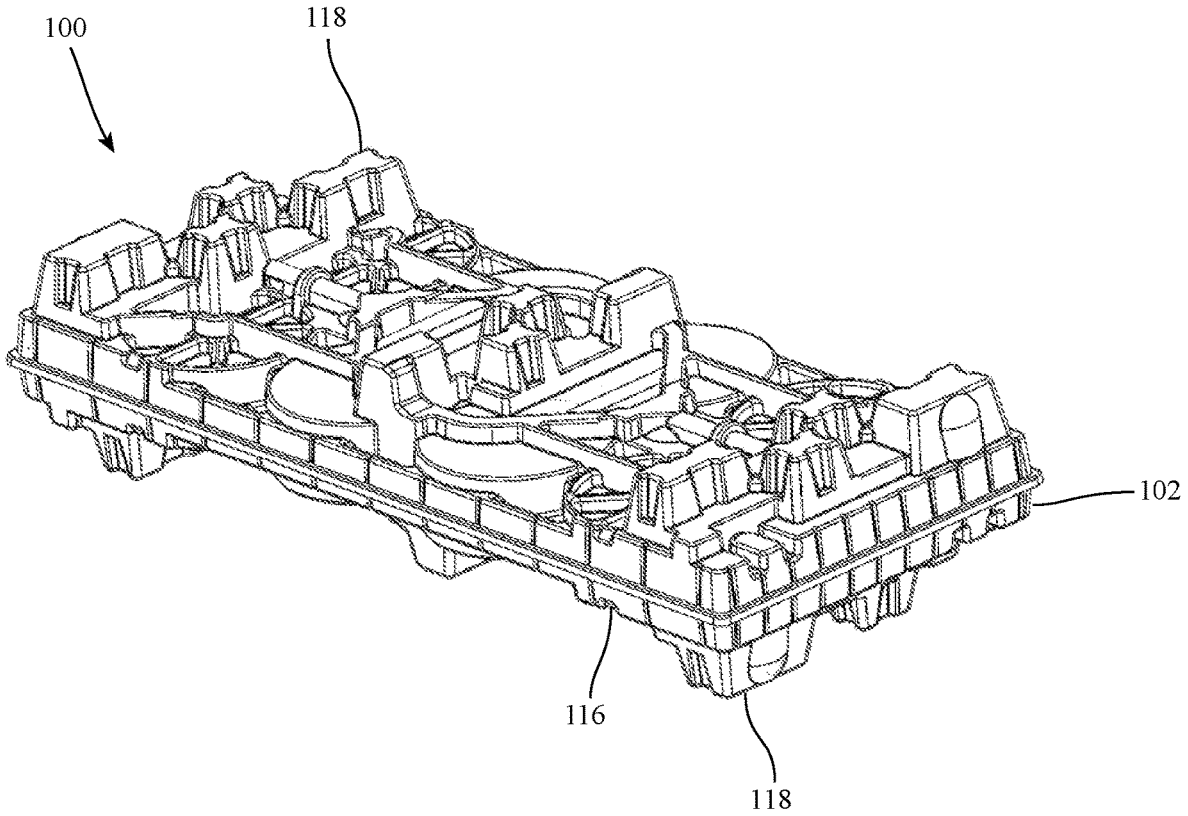
FIG. 8 is a perspective top view of a pallet assembly according to one embodiment of the present disclosure.

With further reference to FIG. 2, the pallet body 102 may include a sidewall projecting upwardly from the pallet body 102. Referring to FIG. 4, the pallet 100 may further include a cap 114 that is shaped to fit over the pallet body 102. In one embodiment, the cap 114 is molded having the same shape as the pallet body 102 including the cutouts or other shaped portions formed therein. Sidewalls of the cap 114 may be trimmed such that sidewalls of the cap 114 may fit over or within the sidewalls of the pallet body 102.

The pallet body 102 and the cap 114 may include a plurality of notches 116 formed on outer surfaces of the pallet body 102 and the cap 114. The plurality of banding notches 116 are shaped to receive a strap, band, or other securing means around the cap 114 and the pallet body 102 to secure the cap 114 on the pallet body 102. When the cap 114 is secured to the pallet body 102, items on the pallet body 102 are substantially secured between the cap 114 and the pallet body 102.

Both the cap 114 and the pallet body 102 may include one or more feet 118 projecting from the cap 114 and the pallet body 102. The feet 118 may be located such that the pallets 100 may be stacked on top of one another, as shown in FIG. 4. The feet 118 may be offset such that when one or more pallets 100 are stacked on top of one another, the feet 118 substantially interlock or fit together with one or more feet 118 of an adjoining pallet. The feet 118 may further have a height such that the pallet 100 is at least partially spaced above a floor surface such that the pallet 100 may be lifted, such as with a forklift.

Embodiments of the pallet 100 disclosed herein advantageously enable items placed on the pallet 100 to be secured such that the items enhance a strength or rigidity of the pallet, thereby reducing the need for additional structural reinforcement members that may add additional weight and cost to the pallet or increase complexity of forming the pallet. The first item 106 may fit on the pallet towards a lower portion of the pallet body 102, while additional items are optionally secured on the pallet 100 on top of the first item 106 such that the first item 106 may support weight of the additional items. The items may be readily removed from the pallet 100 and the pallet 100 subsequently re-used for the storage of the same or similar items. The pallet 100 may further include cutouts, recesses, or other portions for storing other various items on the pallet 100. The pallet 100 further may be returned and re-used for shipping, further reducing costs. For example, portions of the pallet body 102 may be shaped to receive other fitness equipment such as kettle bells, medicine balls, exercise straps, and other equipment. Additional items may be located, for example, within a center portion of the first item 106 if the first item 106 includes an open middle portion.

Figure 9:
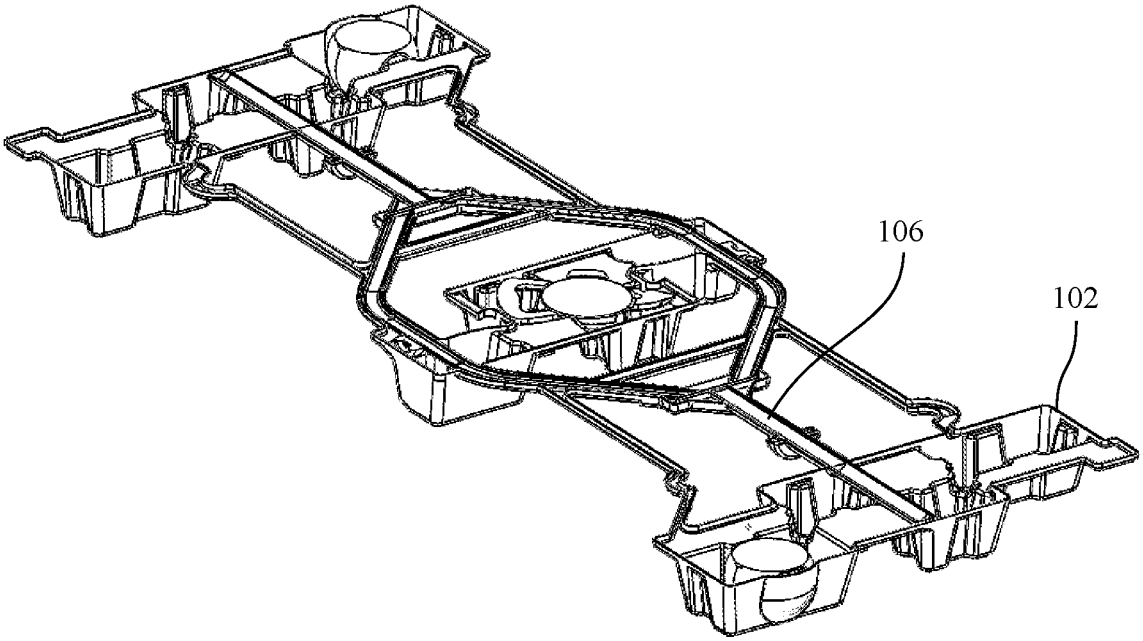
FIG. 9 is a cross-sectional top perspective view of a pallet assembly according to one embodiment of the present disclosure.
Figure 10:
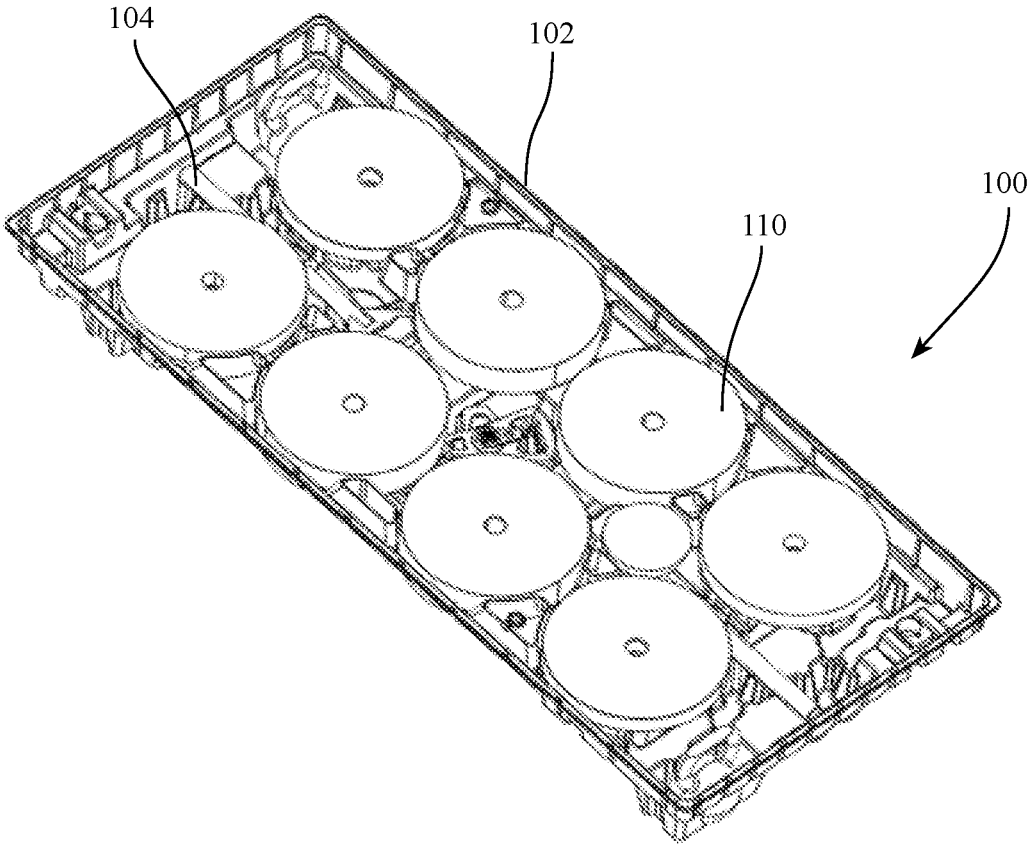
FIG. 10 is a top perspective view of a pallet assembly according to one embodiment of the present disclosure.
Figure 11:
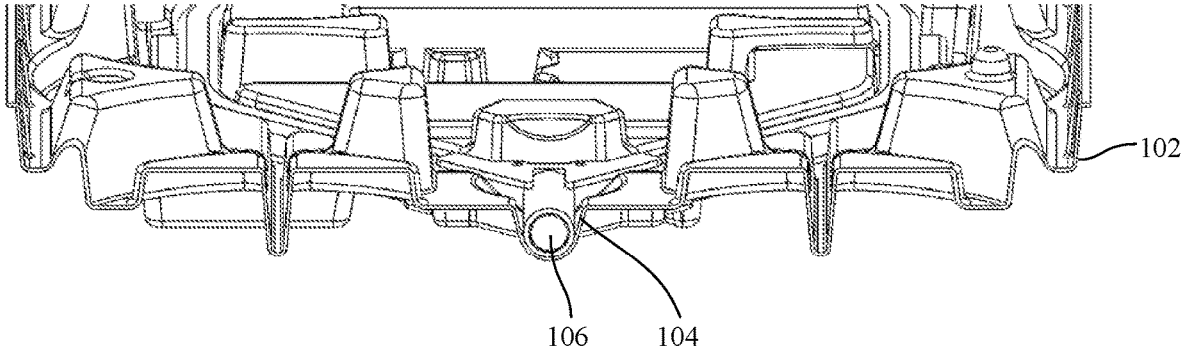
FIG. 11 is a cross-sectional end view of a pallet assembly according to one embodiment of the present disclosure.

As shown in FIG. 9, the first item 106 is located on the pallet body 102 such that the first item 106 extends substantially along a length of the pallet body 102. The first item 106 is preferably retained on the pallet body 102 such that the first item 106 lends structural rigidity to the pallet body 102, such as along a length of the pallet. For example, the pallet body 102 may be constructed such that when the first item 106 is not on the pallet body 102, the pallet body 102 may be flexible and formed of a relatively thin or lightweight material. When the first item 106 is retained on the pallet body 102, the first item 106 is retained on the pallet body 102 at the first formed portion such that the first item 106 enhances a rigidity of the pallet body 102, such as by aiding the pallet body 102 in resisting bending along a length of the pallet. Referring to FIG. 10, when a second item is placed on the pallet 100, such as the one or more weights 110, the second item is supported on the pallet body 102 and the first item 106. The first item 106 is retained in the first formed portion 104 of the pallet body 102 to add support to the pallet 100, as shown in FIG. 11.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A pallet for transporting exercise equipment, the pallet comprising:

a pallet body having a first side and an opposing second side, the pallet body having flex along a length of the pallet body;

a formed exercise equipment portion located on the first side of the pallet body and oriented on the pallet body such that the formed exercise equipment portion is oriented parallel to a lengthwise axis of the pallet body, the formed exercise equipment portion including a channel that is shaped to removably secure one or more pieces of exercise equipment to be transported on the pallet within the formed exercise equipment portion of the pallet body;

wherein when the one or more pieces of exercise equipment are removably secured on the formed exercise equipment portion such that a flex along the length of the pallet body is reduced by the one or more pieces of exercise equipment during transportation of the one or more pieces of exercise equipment on the pallet.

2. The pallet of claim 1, further comprising a cap shaped to fit over the first side of the pallet body such that edges of the cap fit over edges of the pallet body.

3. The pallet of claim 1, wherein the channel of the formed exercise equipment portion is located substantially along a length of the pallet body.

4. The pallet of claim 1, wherein the pallet body is formed of one or more of a plastic and polymer material.

5. The pallet of claim 1, the pallet body further comprising one or more cutouts for supporting one or more exercise items within the pallet body adjacent to the formed exercise equipment portion.

6. The pallet of claim 5, wherein the one or more cutouts are located such that the one or more exercise items are located on top of the one or more pieces of exercise equipment when the one or more pieces of exercise equipment are in the formed exercise equipment portion of the pallet.

7. The pallet of claim 6, wherein the cutouts are shaped to receive a plurality of weight plates on top of the one or more pieces of exercise equipment.

8. The pallet of claim 7, wherein the cutouts are located such that the plurality of weight plates located thereon at least partially overlap with the at least one formed exercise equipment portion and the one or more pieces of exercise equipment located thereon when the one or more pieces of exercise equipment is in the formed exercise equipment portion of the pallet.

9. A pallet for transporting exercise equipment, the pallet comprising:

a pallet body having a first side and an opposing second side, the pallet body having flex along a length of the pallet body;

a formed exercise equipment portion located on the first side of the pallet body and oriented on the pallet body such that the formed exercise equipment portion is oriented parallel a lengthwise axis of the pallet body, the formed exercise equipment portion being shaped to removably secure a one or more pieces of rigid exercise equipment to be transported on the pallet within the formed exercise equipment portion of the pallet body;

one or more cutouts for supporting one or more exercise items within the pallet body adjacent to the formed exercise equipment portion, wherein the one or more cutouts are located such that the one or more exercise items are located at least partially on top of the one or more pieces of rigid exercise equipment when the one or more pieces of rigid exercise equipment is in the formed exercise equipment portion of the pallet;

wherein when a one or more pieces of rigid exercise equipment are removably secured on the formed exercise equipment portion such that a flex along the length of the pallet body is reduced by the one or more pieces of rigid exercise equipment during transportation of the one or more pieces of rigid exercise equipment on the pallet.

10. A pallet for transporting exercise equipment, the pallet comprising:

a pallet body having a first side and an opposing second side, the pallet body formed of one or more of a plastic and polymer material;

a formed exercise equipment portion located on the first side of the pallet body and oriented on the pallet body such that the formed exercise equipment portion is oriented parallel to a lengthwise axis of the pallet body, the formed exercise equipment portion being shaped to removably secure a one or more pieces of exercise equipment to be transported on the pallet within the formed exercise equipment portion of the pallet body;

one or more cutouts for supporting one or more exercise items within the pallet body adjacent to the formed exercise equipment portion, wherein the one or more cutouts are located such that the one or more exercise items are located at least partially on top of the one or more pieces of exercise equipment when the one or more pieces of exercise equipment are in the formed exercise equipment portion of the pallet;

a cap shaped to fit over the first side of the pallet body and over the one or more pieces of exercise equipment when the one or more pieces of exercise equipment are located in the formed exercise equipment portion of the pallet body;

wherein when the one or more pieces of exercise equipment are removably secured on the formed exercise equipment portion, a flex along the length of the pallet body is reduced by the one or more pieces of exercise equipment during transportation of the one or more pieces of exercise equipment on the pallet.

* * * * *